US006547606B1

(12) United States Patent
Johnston et al.

(10) Patent No.: US 6,547,606 B1
(45) Date of Patent: Apr. 15, 2003

(54) TERMINATION ASSEMBLY FORMED BY DIVERSE ANGULARLY DISPOSED CONDUCTORS AND TERMINATION METHOD

(75) Inventors: James J. Johnston, St. Petersburg, FL (US); Gordon Udall, North Attleboro, MA (US)

(73) Assignee: Methode Development Company, Chicago, IL (US)

( * ) Notice: Subject to any disclaimer, the term of this patent is extended or adjusted under 35 U.S.C. 154(b) by 0 days.

(21) Appl. No.: 09/975,401

(22) Filed: Oct. 10, 2001

(51) Int. Cl.[7] ..... H01R 3/00
(52) U.S. Cl. ..... 439/708; 174/88 R
(58) Field of Search ..... 439/164; 174/88 R, 174/87

(56) References Cited

U.S. PATENT DOCUMENTS 4,065,199 A 12/1977 Andre et al.
4,255,612 A * 3/1981 Grundfest ..... 174/117 A
4,315,662 A * 2/1982 Greenwood et al. ..... 174/88 R
5,045,641 A * 9/1991 Urushibata et al. ..... 174/71 R
5,833,477 A * 11/1998 Zahn ..... 439/15
5,857,259 A * 1/1999 Johnston ..... 174/76
5,962,813 A 10/1999 Shirako et al.
6,004,170 A * 12/1999 Kato et al. ..... 174/84 R

* cited by examiner

*Primary Examiner*—Neil Abrams
*Assistant Examiner*—Phuong Dinh
(74) *Attorney, Agent, or Firm*—McCormick, Paulding & Huber LLP

(57) ABSTRACT

A clock spring wiring harness for an automotive steering apparatus has a resilient flexible flat cable containing flat conductors and terminated at its opposite ends by lead conductors. The flat cable is connected between a reel about which it is spirally wound and a fixed housing which supports the reel for rotation therein. The flat conductor/lead conductor terminations are formed by assembly of a stepped series of cradle assemblies integrally formed on and contained within terminal block ultrasonically welded together in assembly while subjected to a predetermined compressive force. Each lead conductor is normal to and continuously biased into direct electrical contacting engagement with an associated flat conductor in a region of termination defined by an associated one of the cradle assemblies.

24 Claims, 9 Drawing Sheets

TERMINATION ASSEMBLY FORMED BY DIVERSE ANGULARLY DISPOSED CONDUCTORS AND TERMINATION METHOD

FIELD OF THE INVENTION

This invention relates in general to electrical connections and deals more particularly with a termination assembly formed by angularly related diverse electrical conductors which extend in transverse directions relative to each other in a region of connection therebetween.

BACKGROUND OF THE INVENTION

Current automotive industry requirements mandate the transmission of electrical signals and power to electrical components carried by a steering wheel of a motor vehicle and connected by a resilient flexible wiring harness to other associated electrical components located at one or more fixed positions remote from the steering wheel. The number of circuit paths provided by such a wiring harness will vary depending upon the requirements of a particular vehicle. Power may, for example, be supplied by the wiring harness to an airbag deployment device associated with an airbag carried by the steering wheel upon occurrence of a predetermined condition such as a vehicular collision. The circuits may also provide electrical connection between components, such as switching devices, mounted on the steering wheel for operating a cruise control system and/or manually activating a signaling device or turn signal lamp mounted in fixed position on the vehicle at a location remote from the steering control apparatus. The wiring harness may also be employed to transmit signals to visual instrumentation mounted on the steering wheel in response to operation of remote sensors to indicate engine operation conditions or the like.

A wiring harness associated with the steering apparatus generally comprises a flat clock spring type wiring harness which facilitates relative rotational motion between the steering wheel and its supporting structure and includes a multi-conductor flexible flat cable (FFC) terminated at both of its ends by discreet electrically conductive members preferably disposed at right angles relative to the conductors which comprise the FFC. Examples of other automotive steering wheel wiring harnesses of the general type hereinbefore described and which require abrupt changes in direction at points of connection between diverse electrical conductors are found in U.S. Pat. No. 5,833,477 to Zahn for Device For Transmitting Electrical Signals Between Components Which Can Be Rotated Relative To Each Other, issued Nov. 10, 1998.

Heretofore two types of termination assemblies and methods have generally been employed to achieve electrical termination of a clock spring wiring harness within the circular motion environment hereinbefore discussed. Each termination assembly and method utilizes an intermediate element connected between an FFC and diverse conductors which terminate it to facilitate required abrupt directional change in the circuit paths provided by the harness. One such termination assembly and method utilizes a double sided printed circuit board (PCB) featuring plated through holes PTH to establish right angle terminations at opposite ends of a resilient FFC which comprises a flat clock spring wiring harness. The circuit paths on opposite sides of the circuit board are disposed at right angles relative to each other and connected by the PTH to provide right angle connection between the FCC and the diverse conductors which terminate it.

Another termination assembly and terminating method currently employed utilizes a stamped and formed lead frame molded into a plastic carrier to provide required right angle termination of an FFC which comprises the clock spring portion of a wiring harness. However, both of the aforedescribed assemblies and methods require two soldered or welded terminations to complete each 90° input circuit to the FFC and two soldered or welded connections to complete each 90° output circuit from the FFC, all of which adds substantially to the cost of producing a clock spring wiring harness. Further, the presence of numerous soldered or welded connections in the harness assembly introduces a serious risk of harness failure due to shock and/or vibration normally encountered in motor vehicle operation.

Accordingly, it is the general aim of the present invention to provide an improved clock spring wiring harness assembly which includes a resilient FFC terminated by diverse angularly disposed conductors wherein the diverse conductors are terminated directly to the FFC, thereby eliminating need for an intermediate terminating element such as a PCB or a lead frame, as hereinbefore discussed. It is a further aim of the present invention to provide an improved termination assembly and method for producing an array of 90° terminations between diverse electrical conductors wherein each conductor is directly terminated to an associated conductor to provide a termination substantially immune to shock and vibration to increase mean time before failure (MTBF) and reduce production cost.

SUMMARY OF THE INVENTION

In accordance with the present invention an improved electrical termination is provided which comprises one axially elongated resilient electrical conductor having a termination portion, another axially elongated resilient electrical conductor having an electrical contacting portion, and a cradle assembly having a cradle and a cradle cap and made from ultrasonically weldable dielectric material. The cradle has an upwardly facing cradle surface and a cradle slot which extends through the cradle in a first direction of extent and opens through opposite sides of the cradle and through the cradle surface. The cradle slot receives and partially compliments the termination portion of the one electrical conductor and maintains an associated portion of the conductor in the first direction of extent in a region of termination defined by the slot. Aligning means is provided for positioning the contacting portion of the other electrical conductor in overlying electrical contacting engagement with the terminating portion of the one conductor and maintaining an associated portion of the other electrical conductor in a second direction of extent normal to the first direction of extent in the region of termination both during and after assembly of the cradle cap with the cradle. The termination further includes connecting means for securing the cradle cap in ultrasonically welded assembly with the cradle and continuously resiliently biasing said one and the other electrical conductors into electrical contacting engagement in the region of termination.

DETAILED DESCRIPTION OF PREFERRED EMBODIMENT AND METHOD

Figure 1:
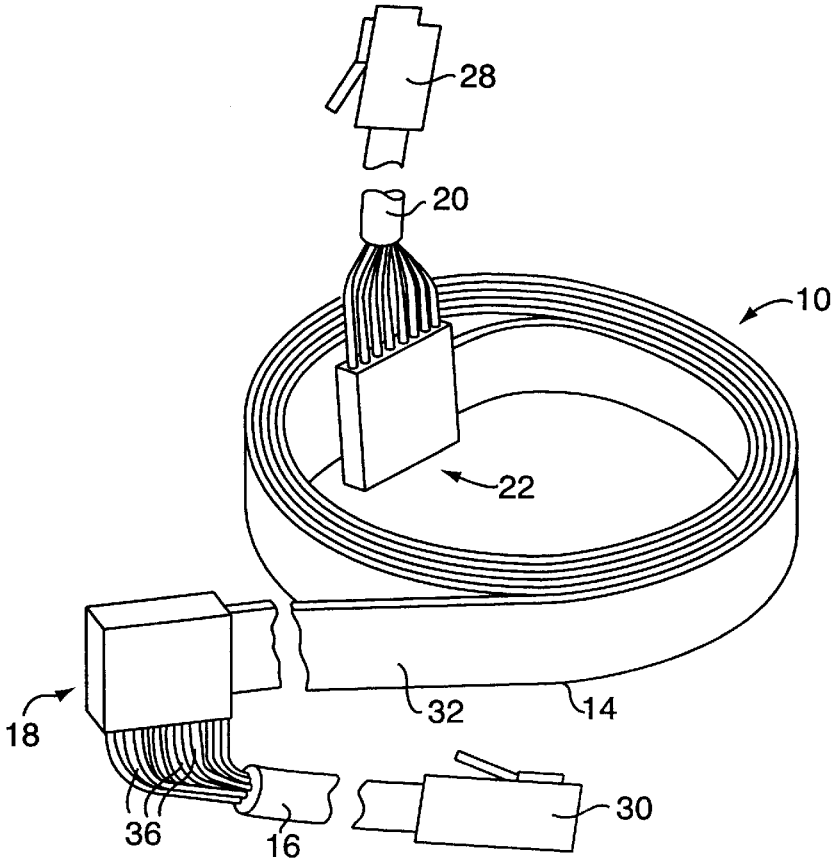
FIG. 1 is a fragmentary perspective view of an improved clock spring wiring harness embodying the present invention.

In the drawings and in the description which follows electrical terminations embodying the present invention and made in accordance with the invention are illustrated and described with reference to an improved clock spring wiring harness shown in FIG. 1 and indicated generally by the reference numeral 10. The illustrated wiring harness 10 is particularly adapted for use in a wiring harness assembly for an automotive steering apparatus and forms a part of such an assembly shown somewhat schematically in FIG. 2 and designated generally by the reference numeral 12.

Referring further to FIG. 1, the illustrated clock spring wiring harness 10 essentially comprises a resilient insulated flexible flat electrical cable (FFC) 14 containing a plurality of flat electrical conductors and adapted to be spirally wound in the manner of a flat clock spring. The outer end of the spirally wound cable 14, hereinafter referred to as the input end, is terminated by a flexible input cable 16 which includes a plurality of individually insulated stranded wire conductors, the terminations being formed by and contained within a terminal block indicated generally at 18. In like manner the other or inner end of the spirally wound cable 14 is terminated by a flexible output cable 20, the further terminations being formed by and contained within another terminal block designated generally by the numeral 22.

Figure 2:
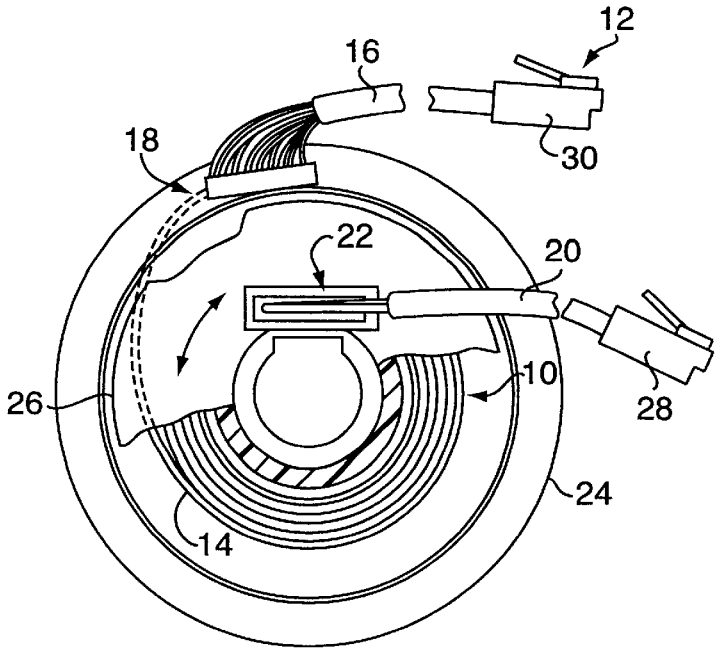
FIG. 2 is a fragmentary top plan view of a clock spring wiring harness assembly for an automotive steering apparatus and having a wiring harness embodying the present invention.

Referring now to FIG. 2 the illustrated wiring harness assembly 12 has a housing 24 for mounting in fixed position within and/or relative to a steering column or other steering wheel supporting structure (not shown). The harness assembly 12 further includes a rotary hub or reel 26 disposed within the housing 24 for keyed connection to and coaxial rotation with a vehicle steering wheel (not shown). As viewed from above in FIG. 2 the clock spring wiring harness 10 is spirally wound in clockwise direction about the hub or reel 26. The terminal block 22 at the inner end of the harness is mounted in fixed position on the hub 26 whereas the terminal block 18 at the outer end of the harness is supported in fixed position on the fixed housing 24. Rotation of the hub 26 in one or in an opposite direction in response to the rotation of an associated steering wheel winds or unwinds the clock spring cable 14 carried by the hub as indicated by the directional arrows in FIG. 2.

The output cable 20 carries an electrical connector 28 for mating connection to an associated connector (not shown) mounted on an input lead connected to various electrical components carried by the steering wheel. The flexible input cable 16 connected to the input terminal block 18 carries an electrical connector 30 for mating connection with another connector (not shown) mounted on another electrical lead to transmit signals and/or power between the wiring harness 10 and other electrical components which may be located in fixed position or positions on the vehicle remote from the steering control apparatus. Examples of other automotive steering wheel wiring harness assemblies in which the harness 10 may be advantageously employed are found in aforementioned U.S. Pat. No. 5,833,477 to Zahn, which is hereby adopted by reference as part of the present disclosure.

Figure 3:
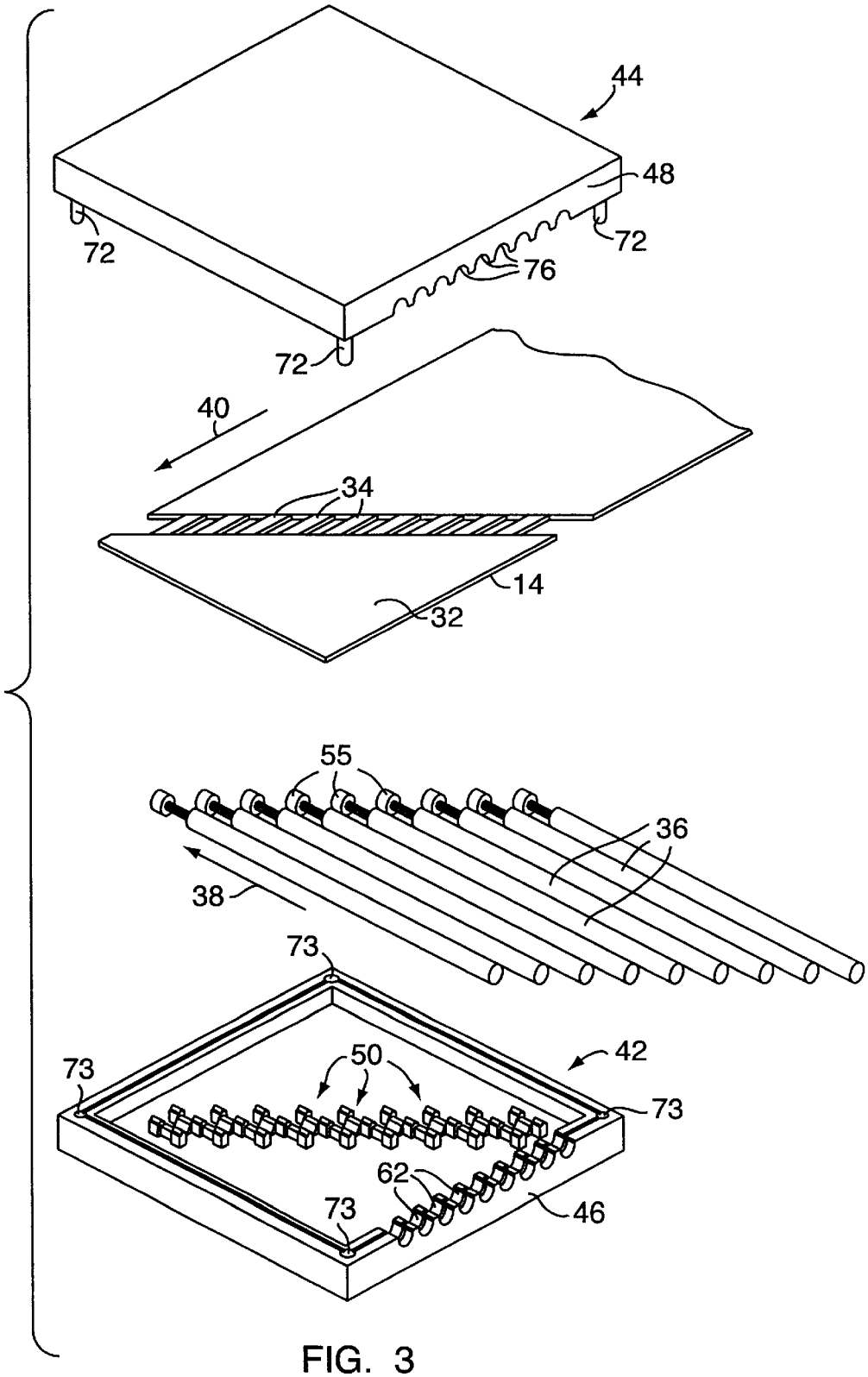
FIG. 3 is a somewhat enlarged exploded perspective view of a termination block comprising part of the wiring harness of FIGS. 1 and 2.

Considering now the clock spring wiring harness 10 in further detail and referring first particularly to FIGS. 1 and 3, the resilient flexible flat cable 14 has an outer insulation jacket 32 and contains a plurality of spaced apart substantially parallel flat electrical conductors 34, 34. The latter conductors are preferably made from a resilient highly electrically conductive material, such as a high tensile beryllium copper, which imparts resilience to the wound flat cable 14. Further resilience may be imparted to the cable by resilient material from which the outer insulation jacket 32 is made. The size and number of the conductors contained within the flat cable 14 may vary and will be determined by the number and current carrying capacity of the circuits required for a particular vehicle. Thus, for example, one or more of the conductors in the flat cable 14 may have a greater width and/or thickness dimension than that of other conductors in the cable to provide greater cross sectional area and consequently greater current carrying capacity. However, for the purpose of clear illustration the cable 14 is shown to have nine substantially identical equally spaced apart conductors 34, 34 and is terminated by a plurality of substantially identical insulated stranded wire conductors 36, 36 equal in number to the flat conductors in the cable 14. The illustrated conductors 36, 36 comprise terminal end portions of individual stranded wire conductors which form the insulated input cable 16. It should be noted that the conductor terminal end portions 36, 36 are arranged in parallel spaced apart relation to each other at least in a region of termination and have a direction of extent in the region of termination indicated by the directional arrow 38 in FIG. 3, which is substantially normal to the direction of extent of the flexible flat cable 14 shown by the directional arrow 40.

Termination of the outer end of the cable 14 is effected by the two part terminal block 18 which includes a base indicated generally by the reference numeral 42 and a mating cover designated generally at 44. The configuration of the terminal block may vary, however, the illustrated terminal block 18, which is made from an ultrasonically weldable dielectric material for a purpose which will be hereinafter further evident, has a generally rectangular configuration and is formed by joinder of the base 42 and 44 cover. The base and cover, have mating peripheral walls indicated at 46 and 48, respectively, cooperate in assembly to define a generally rectangular chamber therebetween, and contain a stepped series of cradles assemblies which include generally rectangular cradles blocks 50, 50. The cradle blocks, as shown oriented in the drawings, are integrally connected to the base 42 and project upwardly therefrom, as best shown in FIG. 4.

Figure 4:
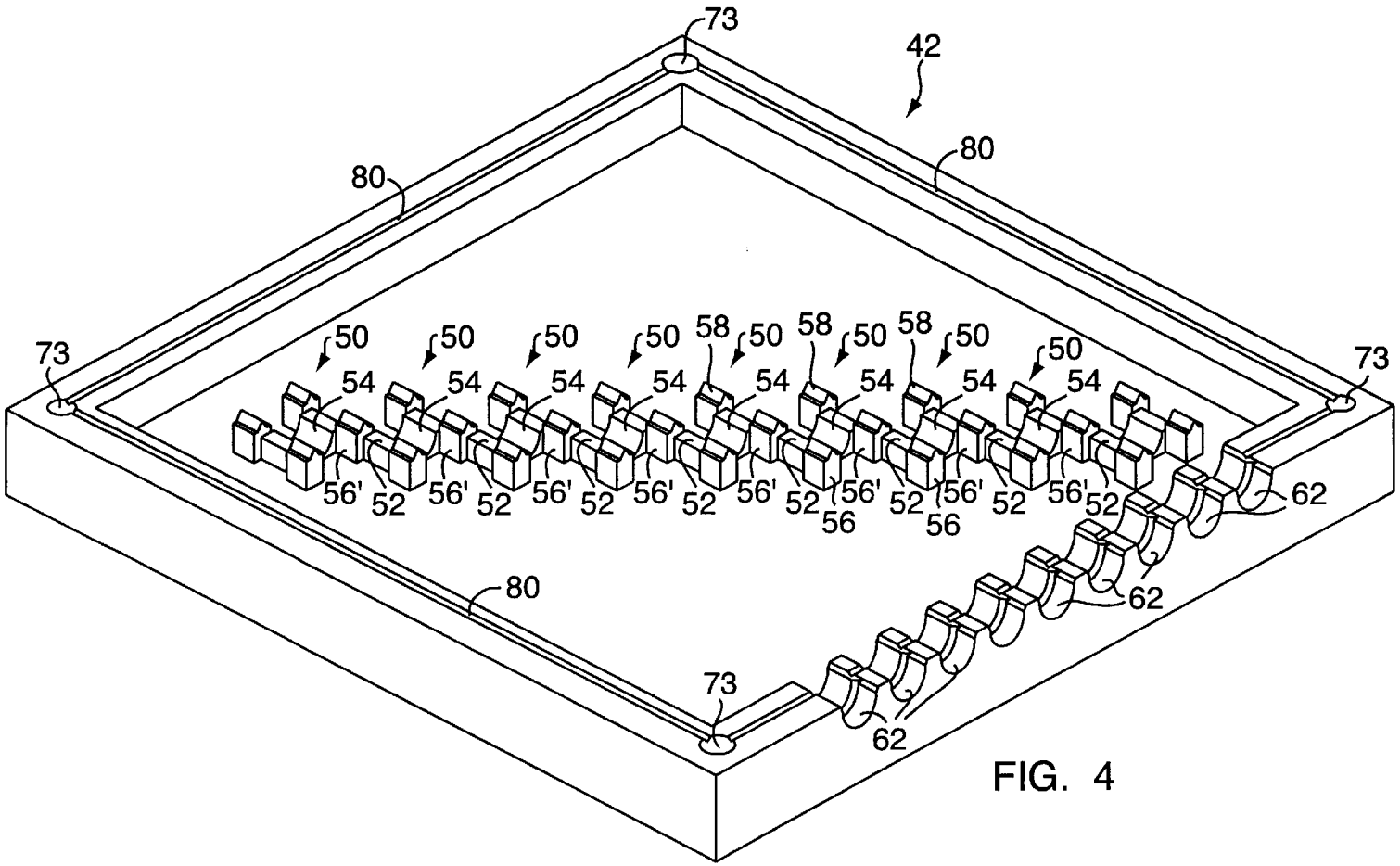
FIG. 4 is a somewhat enlarged perspective view of the termination block base, as viewed from above.
Figure 6:
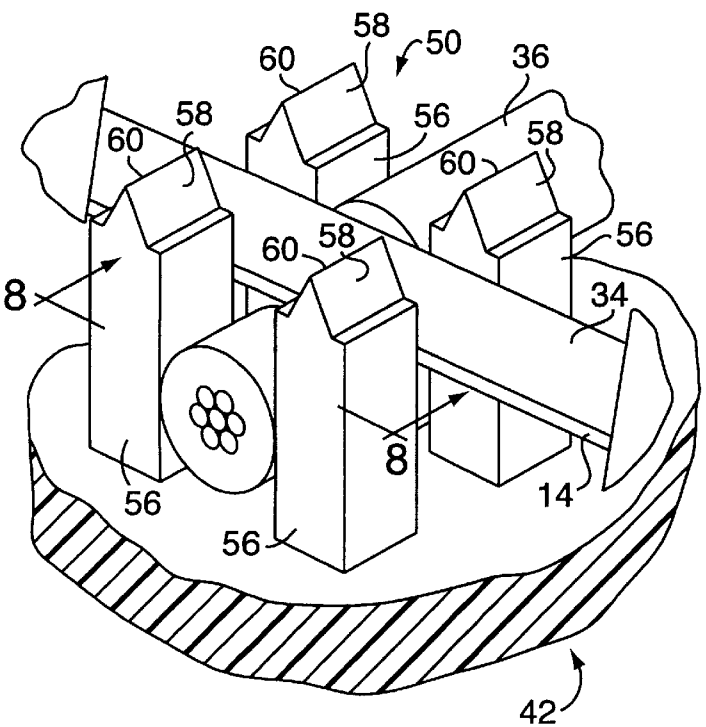
FIG. 6 is a somewhat enlarged fragmentary perspective view of the terminal block base and shows a typical termination cradle.
Figure 8:
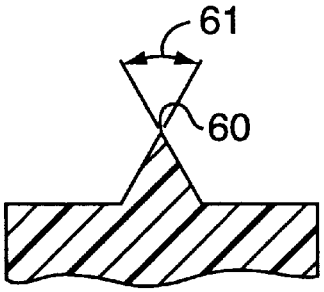
FIG. 8 is a fragmentary sectional view taken along the line 8—8 of FIG. 6.

A typical cradle block 50, as shown oriented in FIGS. 4 and 6 has an upwardly facing cradle surface 52 substantially parallel to the inner upwardly facing surface of the base and includes a cradle slot 54 which extends laterally therethrough in the direction of extent 38 and opens laterally outwardly through opposite sides of the block 50 and upwardly through the cradle surface 52 in the direction of the cover 44. Each cradle block 50 has four associated connecting posts 56, 56 which are integrally connected to and project upwardly from the base 42 proximate corners of the block. As shown, each connecting post 56 has a substantially uniform rectangular cross section, which is preferably square. Due to the stepped or staggered arrangement of the cradle blocks, each cradle block 50 may and preferably does share a common connecting post with the next immediately adjacent cradle block in the series. The common connecting posts, indicated at 56', 56', lie along a line which extends diagonally of the base 42 and is inclined relative to both the direction of extent 40 of the cable 14 and the direction of extent 38 of the conductors 36, 36, as best shown in FIG. 3. The connecting posts 56, 56 and 56', 56' extend for some distance above the cradle surface 52. Each connecting post has at least one secondary energy director 58 which project upwardly from its upper end and extends transversely thereacross. The secondary energy directors 58, 58 each terminate at an apex 60 and form an apex angles of approximately 70 degrees, as best shown in FIG. 8 where the later apex angle is indicated at 61.

The connecting posts at opposite sides of each cradle block 50 are spaced apart a distance approximately equal to the width dimension of a flat conductor 34 to be received therebetween. The two connecting posts at each side of a cradle block are spaced apart a distance approximately equal to but not less than the outside diameter of an associated insulated stranded wire conductor 36 to be received within that cradle slot 54. One side of the base peripheral wall 46 has a plurality of generally semi-cylindrical conductor support grooves 62, 62, each groove being adapted to receive and compliment an associated insulated portion of a stranded conductor 36. Each groove 62 is coaxially aligned with a respectively associated cradle slot 54.

Figure 5:
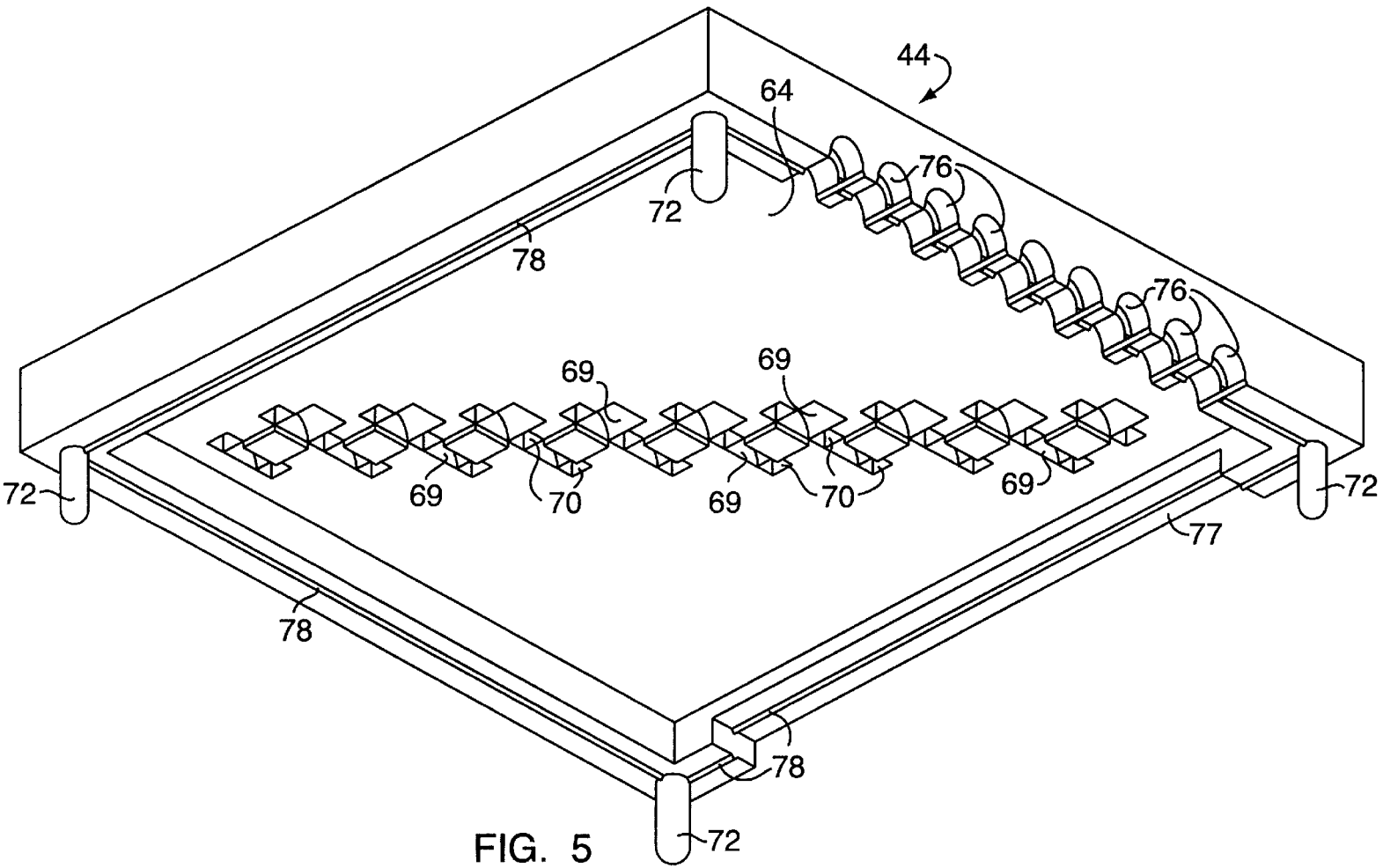
FIG. 5 is a somewhat enlarged perspective view of the terminal block cover, as viewed from below.
Figure 7:
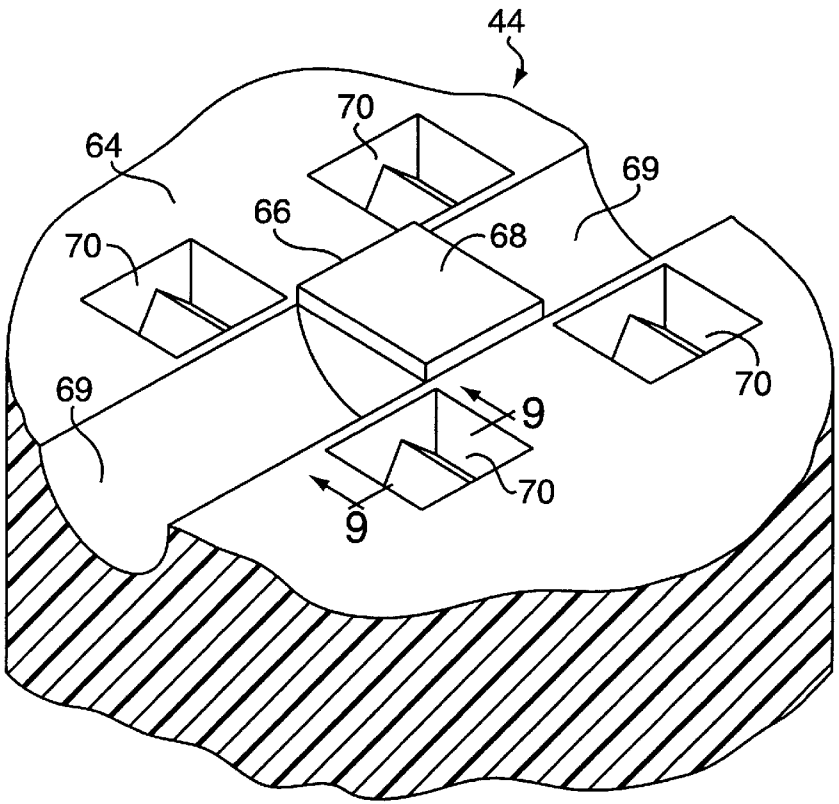
FIG. 7 is a somewhat enlarged fragmentary perspective view of the termination block cover shown in inverted position and illustrates a typical cradle cap.
Figure 9:
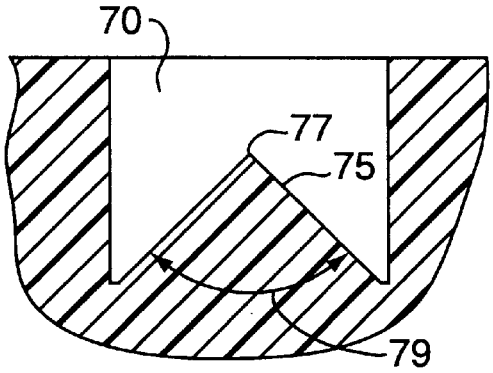
FIG. 9 is a somewhat enlarged fragmentary sectional view taken along the line 9—9 of FIG. 7.
Figure 10:
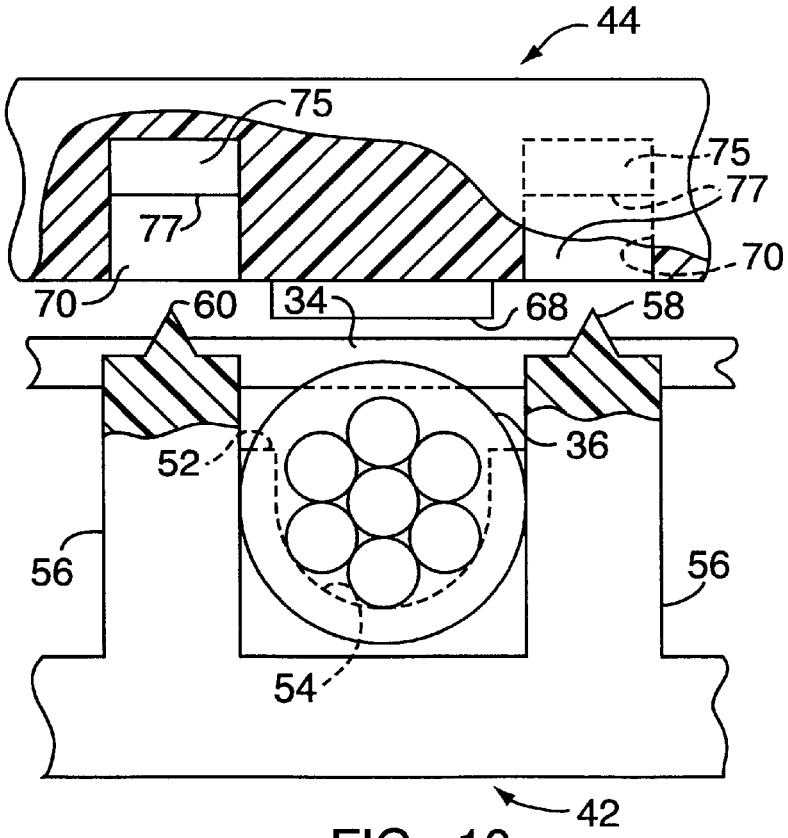
FIG. 10 is a somewhat enlarged exploded fragmentary side elevational view of a typical cradle assembly shown partially in section.

The terminal block cover 44 illustrated in FIG. 5 and shown in inverted position in FIG. 7 has a top wall which defines a substantially planar downwardly facing upper surface 64 which is parallel to the inner surface of the base when the cover is assembled with the base. A plurality of pressure pads 66, 66 depend from the upper surface 64 and define a series of pressure surfaces 68, 68, each pressure surface being in overlying registry with an associated cradle slot 54 when the terminal block cover 44 is assembled with the terminal block base 42. Relief grooves 69, 69 are formed in the cover 44 at laterally opposite sides of each pressure pad 66 and open downwardly through the upper surface 64 to assure clearance for an associated insulated conductor 66 when the cover 44 is assembled with the base 42. A plurality of blind post receiving holes 70, 70 having square cross sections which compliment the cross sections of the square connecting posts 56, 56 and 56', 56' are formed in the cover for registration with the connecting posts when the cover is assembled with the base. Dowel pins 72, 72 depend from the four corners of the cover 44 for engagement within alignment holes 73, 73 formed in the base and position the post receiving holes 70, 70 in alignment with the connecting posts 56, 56 and 56', 56' when the cover is assembled with the base. Each post receiving hole 70 has at least one primary energy director 75 therein, integrally formed on the cover, and aligned with the cover for crossing relation with a secondary energy director or directors on an associated connecting post 56 when the cover 44 is assembled with the base 42. Each primary energy director 75 has a triangular cross section terminates at an apex 77, and forms a 90 degree apex angle 79, as shown in FIG. 9.

One of the peripheral end walls of the cover 44 has a shallow notch 77 therein for receiving and complimenting an associated portion of the insulated flexible flat cable 14 when the cover 44 is assembled with the base 42. One of the peripheral sidewalls of the cover has a plurality of generally semi-cyclindrical conductor insulation support grooves 76, 76 therein for registry with the grooves 62, 62 in the base to receive insulated portions of the conductors 36, 36 when the cover is assembled with the base. During assembly an energy director 78 integrally formed on the peripheral surface of the cover 44 cooperates with the mating peripheral groove 80 formed in the base 42. Additional energy directors are formed on the cover within the grooves 76, 76 and the notch 77 and on the base within the grooves 62, 62 for sealing engagement with the insulated conductors 36, 36 and the insulated cable 14 when the cover is assembled with the base, so that the terminations formed by assembly of the termination block are effectively sealed within the termination block 18.

The width and depth dimensions of the various cradle slots 54, 54 are predetermined by the physical characteristics and dimensions of the conductors 36, 36 to be received therein. Thus, for example, where the conductors which form the termination are stranded soft copper wire conductors such as the illustrated conductors 36, 36, which undergo significant physical cross sectional dimensional change when subjected to a radially directed compressive force within the range of compressive force contemplated by the assembly method of the present invention, this factor must be considered in determining required cradle slot depth. The change in the dimension of a conductor measured in the direction of applied force and produced by application of a force of known magnitude, hereinafter referred to as the compressibility factor of the conductor, is determined for at least one of the particular conductors to be terminated and is employed in determining optimum cradle slot depth dimension. The width dimension of each cradle slot 54 is substantially equal to the undeformed width or diameter of the conductor to be received therein. The preferred depth dimension of the slot, is substantially equal to the diameter of the conductor less an amount determined by applying the compressibility factor for the conductor or conductors to be terminated.

The compressibility factor for a given conductor may, for example, be determined by providing test cradle block (not shown) having an upwardly open test slot with a bottom or inner end wall which compliments an associated lower portion of the conductor to be tested. A ram adapted to be slidably received within the test slot opening and having a downwardly facing bearing surface for engaging a conductor to be tested, which is disposed within the confines of the test slot, is employed to apply to the conductor a downwardly directed force of a predetermined magnitude within the anticipated force range to be encountered in assembling the electrical connection. The resulting compressibility factor, which may be expressed as the percentage change in nominal cross sectional dimension of the tested conductor measured in the direction of applied force in response to a force of known magnitude, is utilized in determining the required depth dimension of the cradle slot.

If each of the conductors to be terminated has a significant compressibility factor the compressibility factor for each of the conductors should be considered in determining required slot depth. The object of the procedure is to utilize the inherent resilience of the conductor materials to attain a termination wherein stored energy is maintained by compressing one or more resilient conductors at a point of termination and whereby the bearing pressure attained and maintained by the joinder of the cradle and cap is sufficient to produce a sustained biasing force resulting in a lasting termination of high integrity. A further discussion of the compressibility factor and the manner in which it is employed to determine slot depth in forming an electrical termination is found in U.S. Pat. No. 5,857,529 to Johnston, coinventor of the present invention, issued Jan. 12, 1999, assigned to the assignee of the present invention, and hereby adopted by reference as part of the present disclosure.

In the illustrated embodiment of the invention the stranded conductors 36, 36 are prepared for termination by stripping a narrow axial length of insulation from each of the stranded wire conductors in spaced relation to an associated end of the conductor, the axially length of the stripped or terminating portion being approximately equal to the axial length of the cradle slot 54 in which the conductor 36 is to be received. After the conductor 36 has been stripped, a narrow band of insulating material, indicated at 55 and best shown in FIGS. 3 and 11 remains on the end portion of the conductor. This band of insulating material 55 controls the free ends of individual wire strands which comprise the conductor 36 which free ends would otherwise tend to fail during subsequent application of ultrasonic energy to the assembly and, as a result, assume uncontrolled positions which could possibly cause electrical shorting.

The stripped or uninsulated terminating portions of the conductors 36, 36 that is the portions of the conductors to be terminated and which are disposed within the cradle slots 54 lie along a line of termination inclined to the direction of extent of the cable 14. As previously noted, the spacing between the connecting posts 56, 56 at transversely opposite sides of the cradle slot is substantially equal to the outside diameter of the insulated conductor, therefore, the four connecting posts 56, 56 associated with the cradle cooperate with the insulation jacket on each wire conductor 36 to coaxially align each conductor with its associated cradle slot during assembly. The insulation support grooves 62, 62 in the base, which are coaxially aligned with the cradle slots further serve to align further portions of the conductors 36, 36 with the terminal block base 42.

The flexible flat cable 14 is preferably prepared for termination by removing a strip of insulating material from the cable along a line of termination inclined or biased relative to its direction of extent 40 to expose uninsulated contacting portions of the flat conductors 34, 34 and spaces therebetween. The insulation strip removed from the cable 14 must be of sufficient width to accommodate the connecting posts 56, 56 and 56', 56' and more specifically to allow the connecting posts to pass upwardly through spaces between the individual flat conductors 34, 34 when the latter conductors are positioned on the cradle blocks 50, 50 in crossing terminating relation to the conductors 36, 36 disposed within the cradle slots. Insulation is preferably removed from the flat cable 14 by an abrading or rotary stripping operation, as for example, by passing the FFC 14 between fiberglass stripping wheels which simultaneously remove insulation from upper and lower surfaces of the cable and from the spaces between adjacent parallel flat conductors 34, 34 which comprise the cable. When the required transverse band of insulation has been removed from and extending across the cable 14, the cable is positioned on the cradle blocks 50, 50 with the connecting posts passing upwardly through the cable or more specifically through the spaces between adjacent flat conductors 34, 34 and within the confines of the stripped portion of the cable. As previously noted, the spacing between the connecting posts measured in the direction of extent of the conductors 36, 36 supported within the cradle slots is such that the connecting posts 56, 56 and 56', 56' cooperate with the flat conductors 34, 34 to align the latter conductors in normal relation to the stranded conductors 36, 36 previously positioned within the cradle slots 54, 54.

When the aforesaid operations have been completed, the terminal block cover 44 is positioned on the terminal block base 42 by engaging the alignment pins 72, 72 on the cover within the alignment holes73, 73 in the corners of the base 42. The cover is then seated on the base to engage the connecting posts 56, 56, and 56', 56' within the post receiving apertures 70, 70 formed in the cover and to bring the secondary energy directors 58, 58 into engagement with the primary energy directors 75, 75.

Final assembly of the terminal block 18 is effected by simultaneous application of an compressive force of predetermined magnitude and high frequency vibratory energy to the terminal block. This operation is performed with an ultrasonic welding machine fitted with a fixture for supporting the terminal block base 42 while assembly pressure and vibratory energy are applied to the terminal block cover 44 by the horn of the machine. The applied vibratory energy melts the secondary energy directors 58, 58 on the connecting posts 56, 56 and 56', 56' and the primary energy directors 75, 75 within the post receiving apertures 70,70 causing the pressure surfaces 68, 68 on the pressure pads 66, 66 carried by the cover to urge the flat conductors 34, 34 into compressing engagement with the stranded wire conductors 36, 36 disposed within the cradle slots 54, 54. The duration of the applied vibratory energy is relatively short and ceases while pressure is being applied to the cover by the horn of the machine. Heat sinks associated with the holding fixture aid in the dissipation of heat so that no significant heating of the base part occurs during assembly. Compressive force of predetermined magnitude is maintained after the application of vibratory energy and until significant cooling has taken place, after which the assembled terminal block 18 may be removed from the welding machine.

Figure 11:
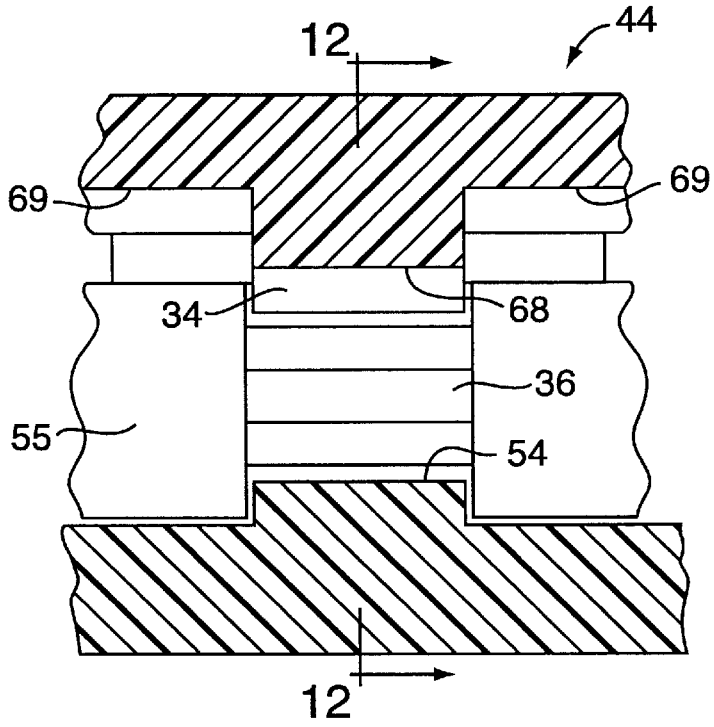
FIG. 11 is a somewhat enlarged axial sectional view through the cradle slot of a typical cradle assembly shown in assembled condition.
Figure 12:
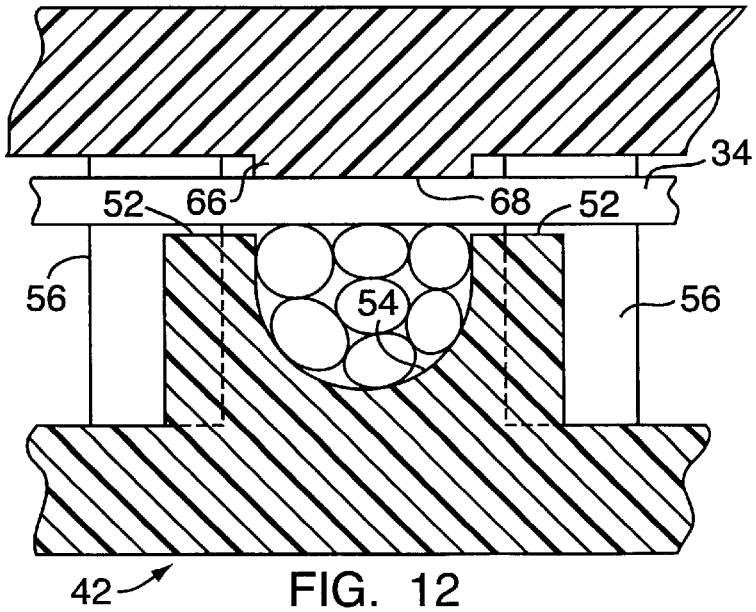
FIG. 12. is a fragmentary sectional view taken along the line 12—12 of FIG. 11.

In FIGS. 11 and 12 a typical cradle assembly is shown in its assembled condition. It will be noted, particularly with respect to FIG. 12, that only the pressure surface 68 engages the flat conductor 34 and that significant clearances are maintained between the conductor 34 and other surfaces of the terminal block 18. The uninsulated contacting position of the flat conductor 34 is in compressing engagement with the terminating portion of the stranded wire conductor 36, which is substantially wholly disposed within the cradle slot 54. The conductor 34, which is disposed in axially normal relation to the conductor 36 bridges the latter conductor and the cradle slot 54 and does not enter the latter slot. In the present instance, the flat conductor 34 is substantially harder than the stranded conductor 36. Consequently, deformation of the conductor 34 in response to the applied force is negligible and, for this reason, a compression factor for the conductor 34 need not be considered.

It will be further noted that substantially all of the deformation of the softer stranded wire conductor 36 occurs within the confines of the cradle slot. The predetermined clearances maintained between the flat conductor 34 and the terminal block 18 in the region of termination shown in FIG. 12 serve to assure that all of the stored energy within the cradle block assembly is utilized in maintaining electrical contact in the region of termination between the conductors 34 and 36. It will also be noted that clearance is maintained between the outer insulation jacket on the conductor 36 and the cradle assembly immediately adjacent the region of termination so th at none of the residual energy stored in the termination is absorbed in compressing the insulation on the stranded wire conductors 36, 36.

Figure 13:
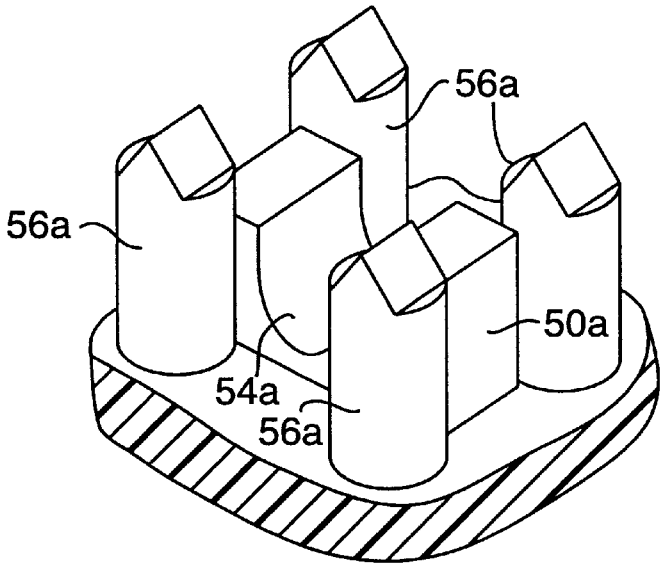
FIG. 13 is similar to FIG. 6 but illustrates another termination cradle which has cylindrical connecting posts.

The invention has been illustrated and described with respect to the termination of a pair of conductors. However, it should be understood that the principles discussed here also apply where three or more conductors are to be terminated. Where more that two conductors are to form a termination, those conductors having the most significant compressibility factors will be stacked within the cradle slot with due consideration of respective compressibility factors thereof in determining slot depth, so that those conductors which undergo the most significant deformation under compression will be confined within the slot.

Wherein array of high density terminations are to be provided connecting posts having a square cross section are preferred, because such posts afford maximum cross sectional area for a given cross sectional dimension. However, where the density of termination and strength of the connecting members are not important design considerations connecting posts of other types may be employed. In FIG. 13, for example, there is shown a cradle 50*a* having cylindrical connecting posts 56*a*, 56*a*. A mating cradle cap (not shown) having complimentary cylindrical post receiving holes will, of course, be provided for use with the illustrated cradle block 50*a*.

The present invention has been illustrated and described with reference to an array of terminations formed by the flat conductors of a FFC and a plurality of discrete stranded wire conductors. However, it should be understood that the termination hereinbefore disclosed may be practiced with conductors of other types. Thus, for example, a termination in accordance with the present invention may be formed by two or more discrete solid wire conductors, two or more individual stranded wire conductors or a combination of discrete solid and stranded conductors. Electrical contacts of various kinds may also be used in forming such a termination and various terminations wherein at least one of the conductors comprises an electrical contact are contemplated within the scope of the present invention.

As previously described, the FFC is prepared for termination by removing a strip of insulation from the cable along a line of termination inclined relative to the direction of cable axial extent 40. Stripping the cable at a stripping angle in the aforesaid manner enables rapid preparation of the cable to facilitate termination.

Figure 14:
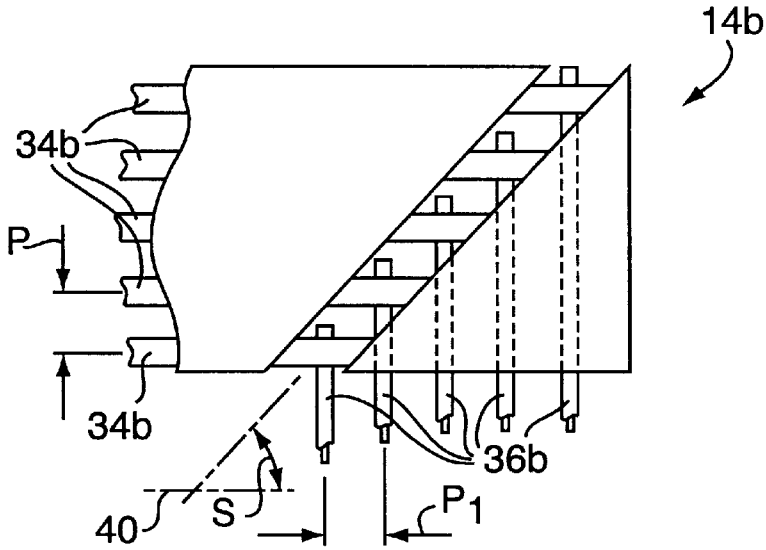
FIGS. 14–16 illustrate changes in the pitch or spacing between output conductors produced by changes in the stripping angle of the FFC.
Figure 15:
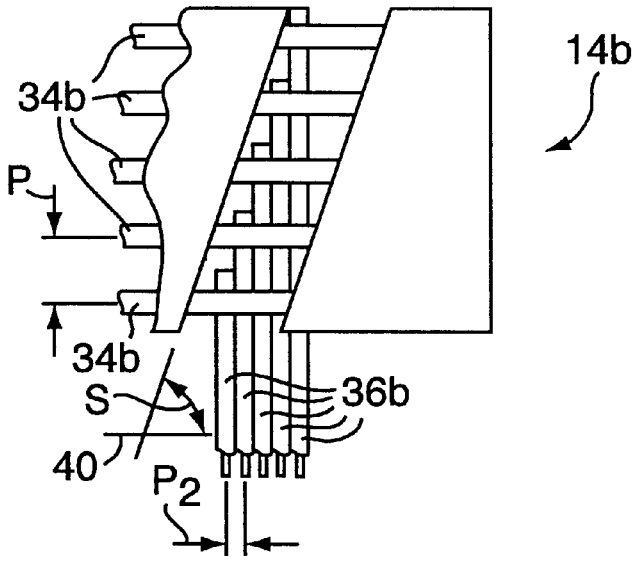
Figure 16:
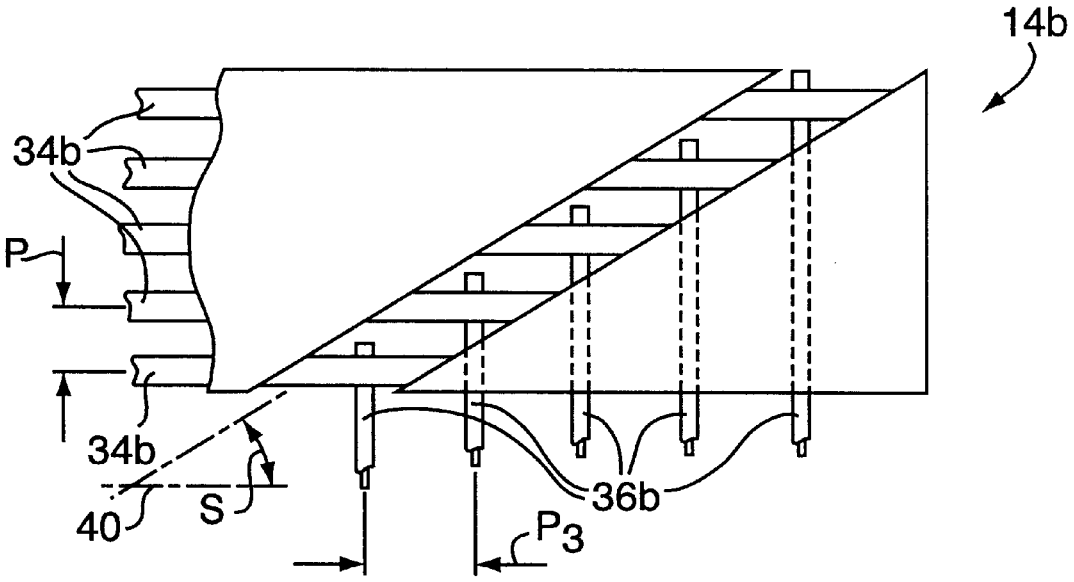

Typical 90° terminations between flat input conductors 34*b*, 34*b* of an FFC 14*b* and discrete output conductors 36*b*, 36*b* are shown in FIG. 14–16 where the stripping angle is indicated by the letter S. The pitch or axial spacing between the uniformly spaced apart flat input conductors of the FFC is fixed and indicated at P. However, the pitch of the output conductors 36*b*, 36*b* is controlled by the stripping angle.

In FIG. 14, where a 45° stripping angle S is shown, the pitch of the output conductors, indicated at P1, is equal to the input conductor P.

An increase in the stripping angle S form 45° results in a decrease in the output conductor pitch as shown in FIG. 15. Conversely, a decrease in the stripping angle S from 45° produces an increase in the pitch of the output conductors, the increased pitch being indicated at P3 in FIG. 16.

We claim:

1. An array of electrical terminations comprising; a plurality of axially elongated first insulated electrical conductors each having an uninsulated electrical terminating portion, a flat electrical cable including an outer jacket of insulating material containing a plurality of axially elongated second electrical conductors, said flat electrical cable having an uninsulated strip defined by the removal of insulating material from said insulating jacket, said uninsulating strip extending, transversely across said cable and biased to the direction of cable extent, each of said second electrical conductors having an uninsulated electrical contacting portion substantially entirely exposed within the confines of said uninsulated strip, and a termination block made from ultrasonically weldable dielectric material and having a base and a mating cover cooperating in assembly with said base to define a stepped series of cradle assemblies between said base and said cover, each of said cradle assemblies including a cradle member and a cradle cap member, said cradle member having a cradle slot extending through said cradle member in a first direction of extent and opening through opposite sides of said cradle and toward said cradle cap member, said cradle slot receiving and partially complimenting said terminating portion of one of said first electrical conductors and maintaining said terminating portion in said first direction of extent in a region of termination defined by said slot, aligning means for locating said contacting portion of each of said second electrical conductors in overlying electrical contacting engagement with said terminating portion of a respectively associated one of said first conductors and maintaining said contacting portion of said associated one of second electrical conductors in a second direction of extent in said region of termination both during and after assembly of said cradle cap member with said cradle member, and connecting members extending through said cable within the confines of said uninsulated strip and securing said cradle cap member in ultrasonically welded assembly with said cradle member and continuously resiliently biasing said contacting portion of said associated one of said second electrical conductor into electrical contacting engagement with said terminating portion of said respectively associated one of said first electrical connectors in said region of termination.

2. An array of electrical terminations as set forth in claim 1 wherein said aligning means comprises said connecting members.

3. An array of electrical terminations as set forth in claim 1 wherein said connecting members comprise a plurality of connecting posts intregally connected to said cradle member and ultrasonically welded to said cap member.

4. An array of electrical terminations as set forth in claim 3 wherein each of said cradle assembling has four said connecting posts.

5. An array of electrical terminations as set forth in claim 3 wherein each of said posts has a generally rectangular cross section.

6. An array of electrical terminations assemblies as set forth in claim 3 wherein said cap member has a plurality of post receiving holes therein, each of said holes receiving an end portion of an associated one if said connecting posts during assembly, said connecting posts being ultrasonically welded in assembly with said cap member within said holes.

7. An array of electrical terminations as set forth in claim 1 wherein said cradle cap member has a pressure pad thereon disposed above and in general registration with said slot and bearing upon said second electrical conductor in assembly.

8. An array of electrical terminations as set forth in claim 1 wherein each cradle assembly in said stepped series is offset in both said first direction of extent and said second direction of extent relative to an immediately proceeding cradle assembly in said series.

9. An array of electrical terminations are set forth in claim 3 wherein said connecting posts are generally cylindrical.

10. An array of electrical terminations as set forth in claim 3 wherein said connecting posts have generally rectangular cross sectional configurations.

11. An array of electrical terminations as set forth in claim 1 wherein said first direction of extent is normal to said second direction of extent.

12. A clock spring wiring harness comprising; a resilient insulated flexible flat electrical cable spirally wound in the manner of a clock spring and including an outer jacket of insulating material containing a plurality of resilient parallel spaced apart first electrical conductors, said flat electrical cable having an uninsulated strip defined by the removal of insulating material from said outer insulating jacket, said uninsulated strip extending transversely across said cable and biased to the direction of cable extent, uninsulated contact portions of said first electrical conductors and spaces therebetween being substantially entirely exposed within the confines of said uninsulated strip and defining a stepped array of uninsulated contact portions, a plurality of lead conductors having parallel spaced apart termination portions, and a terminal block for electrically connecting said termination portion of each of said lead connectors to said contact portion of a respectively associated one of said electrical conductors, said terminal block formed from dielectric material and having a base and a mating cover cooperating in assembly with said base to define a stepped series of cradle assemblies, each of said cradle assemblies including a cradle carried by said base and a cradle cap defined by said cover, said cradle having a cradle slot extending therethrough in a first direction of extent and opening through opposite sides of said cradle and toward said cover before assembly of said cover and said base for receiving and partially complementing said termination portion of an associated one of said lead conductors and maintaining said termination portion in said first direction of extent, said cradle cap defining a pressure surface for registry with said cradle slot, aligning means for positioning a contact portion of a flat electrical conductor in a second direction of extent and in overlying electrical contacting engagement with said termination portion of said associated lead conductor in a region of termination both during and after assembly of said cover with said base, and connecting members extending through said flat electrical cable generally within the confines of said strip and securing said cover in assembly with said base and said cradle cap in assembly with said cradle and continuously resiliently biasing said pressure surface toward and into engagement with said contact portion to continuously maintain electrical contacting engagement between said contact portion of said flat electrical conductor and said terminal portion of said lead conductor in said region of termination.

13. A clock spring wiring harness as set forth in claim 12 wherein said connecting members comprise said alignment means.

14. A clock wiring harness as set forth in claim 12 wherein said connecting members comprise a plurality of posts integrally associated with said base and ultrasonically welded to said cover.

15. A clock spring wiring harness as set forth in claim 14 wherein each cradle assembly has four said posts associated therewith.

16. A clock spring wiring harness as set forth in claim 14 wherein each cradle assembly in said stepped series shares a common connecting post with an adjacent cradle assembly in said stepped series.

17. A clock spring wiring harness as set forth in claim 12 wherein each cradle assembly in said stepped series is offset in both said first direction of extent relative to an immediately preceding cradle assembly in said series.

18. A clock spring wiring harness as set forth in claim 12 wherein said lead electrical conductors comprise insulated stranded electrical conductors and said termination portion of each one of said lead conductors comprises an uninsulated portion adjacent an insulated end portion thereof.

19. A clock spring wiring harness as set forth in claim 12 wherein said first direction of extent is normal to said second direction of extent.

20. A clock spring wiring harness as set forth in claim 12 wherein said terminal block is made from ultrasonically weldable material and said cover is ultrasonically welded in assembly with said base.

21. A clock spring wiring harness as set forth in claim 14 wherein said posts comprise generally cylindrical posts.

22. A clock spring wiring harness as set forth in claim 14 wherein said posts comprise generally rectangular posts.

23. A method for electrically connecting one electrical conductor to another electrical conductor comprising the steps of making a cradle assembly from ultrasonically weldable dielectric material and including a cradle member and a cap member, determining a compressibility factor for at least one of the conductors to be connected, forming an outwardly open cradle slot extending axially through the cradle member and having an inner end wall substantially complementing portion of the one conductor when the one conductor is confined within the cradle slot with its axis substantially parallel to the axis of the cradle slot and a slot depth substantially equal to the height of the confined portion less an amount equal to the compressibility factor, providing a plurality of connecting posts on one of the members including the cradle member and the cap member, forming blind openings in the other of the members including the cradle member and the cap member for receiving end portions of the posts therein, forming coengagable energy directors on the post end portions and within the blind openings, placing the one conductor in its confined position within the cradle slot, positioning another conductor in overlying electrical contacting engagement with the one conductor in confined position, preassembling the cradle cap member with the cradle member with the post end portions in the blind openings and the energy directors in coengagement with each other within the openings, applying compressive force of a predetermined magnitude to the cradle assembly to urge the cap member toward the cradle member and the another conductor toward and into compressing engagement with the one conductor, applying high frequency vibratory energy to the cradle assembly while the compressive force is being applied to the cradle assembly, and ceasing the application of high frequency energy to the cradle assembly while the compressive force of predetermined continues to be applied to the cradle assembly.

24. The method as set forth in claim 23 wherein the step of positioning is further characterized as positioning another conductor in transverse overlying electrical contacting engagement with and relative to the one conductor.

* * * * *